United States Patent [19]

Mudge et al.

[11] Patent Number: 4,865,625

[45] Date of Patent: Sep. 12, 1989

[54] METHOD OF PRODUCING PYROLYSIS GASES FROM CARBON-CONTAINING MATERIALS

[75] Inventors: Lyle K. Mudge, Richland; Michael D. Brown, West Richland; Wayne A. Wilcox, Kennewick; Eddie G. Baker, Richland, all of Wash.

[73] Assignee: Battelle Memorial Institute, Richland, Wash.

[21] Appl. No.: 189,419

[22] Filed: May 2, 1988

[51] Int. Cl.[4] ..... C10J 3/84; C10K 3/02

[52] U.S. Cl. ..... 48/197 R; 48/209; 252/373

[58] Field of Search ..... 48/197 R, 203, 206, 48/209; 252/373

[56] References Cited

U.S. PATENT DOCUMENTS

| | | | |
|---|---|---|---|
| 1,014,654 | 1/1912 | Laird . | |
| 1,677,757 | 7/1928 | Frank | 201/2.5 |
| 3,252,773 | 5/1966 | Solomon et al. . | |
| 3,556,751 | 1/1971 | Slater et al. | 48/215 |
| 3,698,881 | 10/1972 | White | 48/209 |
| 3,708,270 | 1/1973 | Birk et al. | 48/202 |
| 3,759,677 | 9/1973 | White | 48/209 |
| 3,850,588 | 11/1974 | White | 48/209 |
| 3,853,498 | 12/1974 | Bailie | 48/209 |
| 3,888,043 | 6/1975 | Child et al. | 48/197 R |
| 3,989,480 | 11/1976 | Appell et al. | 48/209 |
| 3,993,458 | 11/1976 | Antal | 48/209 |
| 4,028,068 | 6/1977 | Keiner | 48/209 |
| 4,056,483 | 11/1977 | Baron et al. | 48/206 |
| 4,060,041 | 11/1977 | Sowards | 110/8 F |
| 4,082,520 | 4/1978 | Baron et al. | 48/206 |
| 4,108,730 | 8/1978 | Chen et al. | 201/2.5 |
| 4,113,446 | 9/1978 | Modell et al. | 48/209 |
| 4,121,912 | 10/1978 | Barber et al. | 48/197 R |
| 4,135,885 | 1/1979 | Wormser et al. | 422/142 |
| 4,175,211 | 11/1979 | Chen et al. | 585/241 |
| 4,240,927 | 12/1980 | Karweil et al. | 252/411 R |
| 4,300,915 | 11/1981 | Schmidt et al. | 48/209 |
| 4,344,373 | 8/1982 | Ishii et al. | 110/347 |
| 4,372,755 | 2/1983 | Tolman et al. | 48/197 R |
| 4,414,001 | 11/1983 | Kunii | 48/197 E |
| 4,421,524 | 12/1983 | Chittick | 48/209 |
| 4,430,096 | 2/1984 | Schmur et al. | 48/197 R |
| 4,436,532 | 3/1984 | Yamaguchi et al. | 48/214 A |
| 4,441,892 | 4/1984 | Schuster | 48/177 R |
| 4,448,589 | 5/1984 | Liang-tseng Fan et al. | 48/197 R |
| 4,541,841 | 9/1985 | Reinhardt | 48/197 R |
| 4,555,249 | 11/1985 | Leas | 48/62 R |
| 4,568,362 | 2/1986 | Deglise et al. | 48/209 |
| 4,647,203 | 10/1985 | Jahuke | 48/177 R |
| 4,699,632 | 10/1987 | Baber et al. | 48/177 R |
| 4,740,217 | 4/1988 | Lambertz | 48/206 |

*Primary Examiner*—Peter Kratz

*Attorney, Agent, or Firm*—Klarquist, Sparkman, Campbell et al.

[57] ABSTRACT

A gasification process of improved efficiency is disclosed. A dual bed reactor system is used in which carbon-containing feedstock materials are first treated in a gasification reactor to form pyrolysis gases. The pyrolysis gases are then directed into a catalytic reactor for the destruction of residual tars/oils in the gases. Temperatures are maintained within the catalytic reactor at a level sufficient to crack the tars/oils in the gases, while avoiding thermal breakdown of the catalysts. In order to minimize problems associated with the deposition of carbon-containing materials on the catalysts during cracking, a gaseous oxidizing agent preferably consisting of air, oxygen, steam, and/or mixtures thereof is introduced into the catalytic reactor at a high flow rate in a direction perpendicular to the longitudinal axis of the reactor. This oxidizes any carbon deposits on the catalysts, which would normally cause catalyst deactivation.

11 Claims, 1 Drawing Sheet

METHOD OF PRODUCING PYROLYSIS GASES FROM CARBON-CONTAINING MATERIALS

The U.S. Government has a paid-up license in this invention and the right in limited circumstances to require the patent owner to license others on reasonable terms as provided for by the terms of Contract No. DE-AC06-76LO 1830 awarded by the U.S. department of Energy.

BACKGROUND OF THE INVENTION

The present invention generally relates to the gasification of carbon-containing materials to produce fuel gases, and more particularly to a highly efficient gasification method which avoids problems caused by the formation of undesirable system byproducts.

Gasification is a process which generally involves the pyrolytic conversion of solid carbon-containing materials to gaseous products. Gasification is traditionally accomplished by the high temperature thermal breakdown of feedstock materials in the presence of steam, oxygen, air, and/or other suitable gases. Furthermore, gasification may involve either updraft, downdraft, crossdraft, fluid bed or entrained flow systems known in the art.

When carbon-containing materials are gasified, "fuel gas" is produced consisting of CO, $CO_2$, $H_2$, $N_2$, $H_2O$, $CH_4$, and other light hydrocarbons in varying proportions and amounts. Residual tar and oil materials are also produced as byproducts entrained in the pyrolysis gases. These materials are extremely viscous, and condense on piping and other equipment in the gasification system. They may also combine with char produced in the system to form layers of a solid organic residue which are extremely difficult to remove A promising method for removing the undesired tar/oil byproducts as described herein involves catalytic oxidation of the tars and oils However, when tar/oil destruction is accomplished using catalytic processes, carbon is deposited on the catalysts This ultimately deactivates the catalysts, rendering them ineffective.

Many attempts have been made to develop high efficiency gasification systems which minimize the problems described above. For example, U.S. Pat. No. 4,344,373 to Ishii et al discloses a gasification system including a fluidized bed pyrolysis reactor in which the endothermic decomposition of waste occurs, and a fluidized bed combustion reactor for the exothermic combustion of char, oils, and tar.

U.S. Pat. No. 4,135,885 to Wormser et al discloses a chemical reactor having a first upstream fluidized bed in combination with a second downstream fluidized bed. The upstream bed is designed to burn coal, while the downstream bed desulphurizes the gases produced from the burning coal.

Other gasification systems of interest are disclosed in U.S. Pat. Nos. 4,541,841 to Reinhardt; 4,300,915 to Schmidt et al; 4,028,068 to Kiener; 4,436,532 to Yamaguchi et al; 4,568,362 to Deglise et al; 4,555,249 to Leas; 4,372,755 to Tolman et al; 4,414,001 to Kunii; and 3,759,677 to White.

However, a need still exists for a highly efficient gasification system in which problems associated with undesired tar/oil formation and catalyst contamination are controlled. The present invention accomplishes these goals, and represents an advance in the art of gasification technology.

SUMMARY OF THE INVENTION

It is an object of the present invention to provide a gasification process for pyrolyzing carbon-containing materials in a highly efficient manner It is another object of the invention to provide a gasification process which is capable of producing substantial amounts of gaseous products from a wide variety of feedstock materials.

It is another object of the invention to provide a gasification process which is simple in design, and uses inexpensive, readily available components.

It is another object of the invention to provide a gasification process capable of minimizing problems associated with the undesired formation of tar/oil byproducts.

It is a further object of the invention to provide a gasification process which uses separate reactor systems for the gasification of carbon-containing materials and elimination of undesired tar/oil byproducts.

It is an even further object of the invention to provide a gasification process which minimizes problems associated with catalyst fouling and contamination.

In accordance with the foregoing objects, a gasification process of improved efficiency is disclosed. The process uses a dual bed reactor system in which carbon-containing feedstock materials are first treated in a gasification reactor to form pyrolysis gases. The gasification reactor may involve a fixed bed, fluidized bed, entrained bed, or other system known in the art. The pyrolysis gases are then directed into a secondary catalytic reactor for the destruction of residual tars/oils in the gases. The secondary reactor consists of a fluidized bed system having a selected reforming catalyst therein Temperatures are maintained within the secondary reactor at a level sufficient to crack the tars and oils present in the gases, but not high enough to cause thermal breakdown of the catalysts. In order to minimize problems associated with the deposition of carbon on the catalysts during tar/oil cracking, a gaseous oxidizing agent preferably consisting of air, oxygen, steam, or mixtures thereof is introduced into the secondary reactor. The oxidizing agent is provided at a high flow rate in a direction perpendicular to the longitudinal axis of the reactor. This results in oxidation of the carbon on the catalysts without significant combustion of the pyrolysis gases.

These and other objects, features and advantages of the invention are presented below in the following detailed description of a preferred embodiment, drawings, and examples.

DETAILED DESCRIPTION OF A PREFERRED EMBODIMENT

Figure 1:
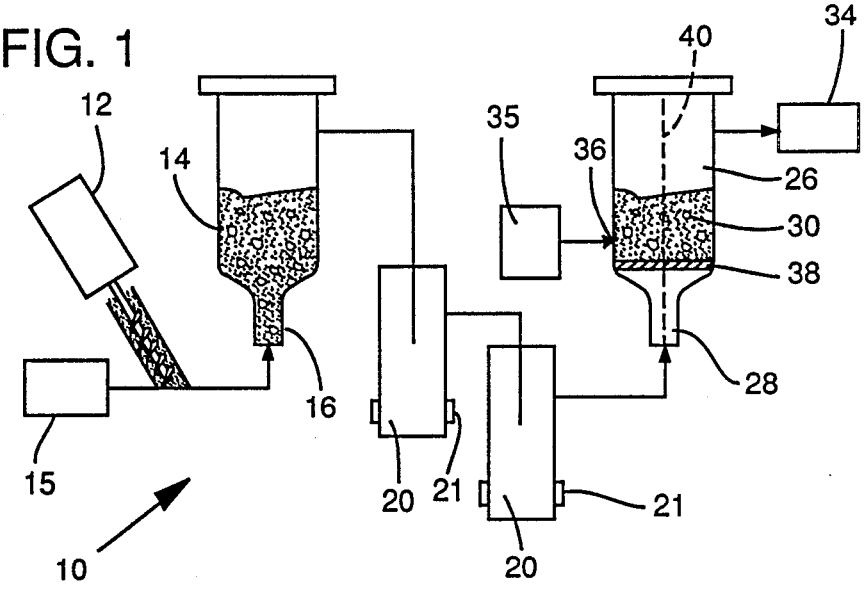
FIG. 1 is a schematic representation of a processing system used in connection with the method of the present invention.

The present invention involves an improved gasification process characterized by a high degree of efficiency and reduced maintenance. A schematic illustration of a system usable in connection with the invention is illustrated in FIG. 1 Basically, a dual bed system 10 is provided in which carbon-containing materials 12 (e.g.

waste vegetable and wood matter, crop residues, sewage sludge, etc.) are first introduced into a gasification reactor 14 which may consist of either a fluidized bed, fixed-bed, entrained bed, or other reactor known in the art and suitable for pyrolysis. In a preferred embodiment, a fluidized bed reactor is used consisting of a vertical cylinder having a 30 cm deep fluidized bed of about 90% sand and 10% char.

A source 15 of steam or other gas typically used in pyrolysis/gasification processes (e.g. air, air/steam mixtures, oxygen/steam mixtures, $CO_2$, or recycled product gases) is introduced into the bottom 16 of the reactor 14 simultaneously with the introduction of carbon-containing materials 12.

Typical pyrolysis temperatures within the reactor 14 range from 600° to 800° C., depending on the type of materials 12 in use. For example, the pyrolysis of wood matter would involve heating equivalent weights of steam and wood at a temperature of about 725° C. Residence time within the reactor 14 also varies, although it typically ranges from 1 to 2 seconds for product gases and 5 to 15 minutes for the char produced during pyrolysis.

As pyrolysis occurs, gaseous products are formed which consist of CO, $CO_2$, $H_2$, $N_2O$, $CH_4$, and/or light hydrocarbon gases in varying proportions and amounts Also produced are considerable amounts of organic tars and oils entrained within the gases which require further treatment. These tars and oils most often include phenols, $C_6$–$C_{20}$ hydrocarbons and pyroligneous acids.

The steam gasification of wood wastes in a fluidized bed reactor can produce as much as 5–10 grams of tars and oils per 100 grams of wood. In many cases, as much as 20% of the feedstock carbon content is ultimately converted to tars and oils. Chemically, the tars and oils are extremely sticky and viscous. They condense on piping and downstream equipment causing a variety of technical problems. They may also combine with char particulates to form nearly impervious layers of solid material.

In accordance with the present invention, the pyrolysis gases produced in the reactor 14 are first passed through cyclone separators or filters 20 for the removal of particulate matter. As previously noted, temperatures of 600°–800° C. are maintained within the reactor 14. By the time the pyrolysis gases reach filters 20, they are still quite warm (+300° C.). The +300° C. temperature insures against the premature condensation of tars and oils in the gases. In addition, each of the filters 20 includes a heater 21 designed to maintain the +300° C. temperature. The heater 21 may involve an electrical resistance system or other type known in the art.

The gases are then introduced into a secondary catalytic reactor 26 of the fluidized bed variety. Pyrolysis gases are introduced into the reactor 26 at the bottom 28 thereof, and are passed through at least one catalyst bed 30. Preferred catalysts for this purpose include nickel-containing reforming catalysts known in the art. The term "reforming catalysts" as used herein signifies those catalysts used industrially for reforming natural gas. Commercially available catalysts suitable for use in the invention are listed below in Table I:

TABLE I

| Catalyst Designation or Trade Name | Source | Composition Wt % Active Metals | Support |
|---|---|---|---|
| NCM | W. R. Grace | 9.5% Ni | $SiO_2$—$Al_2O_3$ |

TABLE I-continued

| Catalyst Designation or Trade Name | Source | Composition Wt % Active Metals | Support |
|---|---|---|---|
| | | 4.25% CuO<br>9.25% $MoO_3$ | |
| G90C TM | United Catalysts | 15% Ni | 70 to 76% $Al_2O_3$<br>5 to 8% CaO |
| G98B TM | United Catalysts | 43% Ni<br>4% Cu<br>4% Mo | Alumina |
| ICI-46-1 TM | Imperial Chemical Industries | 16.5% Ni<br>(21% NiO) | 14% $SiO_2$<br>29% $Al_2O_3$<br>13% MgO<br>13% CaO<br>7% $K_2O$<br>3% $Fe_2O_3$ |

With respect to the "G90C" and "G98B" catalysts, the addition of 2–4% by weight potassium by immersion of the catalysts into a $K_2CO_3$ solution may be used to enhance catalyst durability by preventing at least some carbon deposition on the catalysts. Some types of carbon deposition can result in the removal of nickel from the catalysts listed in Table I. The addition of potassium is often used to prevent this type of carbon deposition, known as "whisker" carbon deposition.

The temperature of reactor 26 should preferably be maintained within a range of 550°–750° C. Above 750° C., the catalyst materials may sinter or fuse and become less active. Passage of the pyrolysis gases through the reactor 26 will result in the destruction of tars and oils entrained within the gases. The resulting gaseous product 34 which leaves the reactor 26 will be substantially free of tars and oils. It will contain predominantly $H_2$, CO, $CO_2$, $CH_4$ and $H_2O$, with lesser quantities of other gases including a variety of light hydrocarbons.

However, the catalytic destruction of tars and oils in the reactor 26 will still result in the deposition of carbon on the surface of the catalysts. This contamination typically plugs microscopic pores in the catalysts, causing catalyst deactivation. Tests have shown that catalysts like those described in Table I will most likely become inactive when their carbon content exceeds 6.0 % by weight. In order to prevent this from happening, a gaseous oxidizing agent 35, preferably consisting of air, oxygen, steam, or mixtures thereof is added to the reactor 26 at position 36 as shown in FIG. 1 continuously during operation of the system. The reactor 26 in its preferred form will most typically include a distributor plate 38 near the bottom 28 thereof, with the catalyst bed 30 being positioned above plate 38. The oxidizing agent 35 should be added above the plate 38 so that it may be directed into the catalyst bed 30. Addition of the oxidizing agent 35 in this manner removes carbon from the catalyst without oxidizing significant amounts of gases such as $H_2$, CO, and $CH_4$. In addition, the oxidizing agent 35 is preferably directed into the reactor 26 in a direction perpendicular to the longitudinal axis 40 of the reactor 26. This procedure imparts a swirling motion to the catalyst, thereby ensuring maximum contact between the oxidizing agent 35 and catalyst.

The oxidizing agent 35 should also be added at a flow rate sufficient to produce a high velocity stream normally exceeding 50 ft/s. The flow rate depends on the amount of tars and oils in the pyrolysis gases. Specifically, pyrolysis gases having a high tar/oil content might warrant an experimentally determined flow rate somewhat higher than 50 ft/s.

The amount of oxidizing agent needed to maintain catalyst activity depends on the the feedstock materials and conditions in the pyrolysis reactor 14. For example, the weight of oxidizing agent (e.g. air) required in the steam pyrolysis of wood at 725° C. is 30–50% of the weight of the wood being pyrolyzed. More specifically, 30–50 pounds of air would be needed for the pyrolysis of 100 pounds per hour of wood, with 30 pounds of air equalling about 400 standard cubic feet per hour (scfh).

The gasification method described above efficiently produces fuel gases while removing tar/oil materials and preventing catalyst contamination. A series of tests illustrating the effectiveness of the invention is presented as follows:

EXAMPLES

Multiple test runs were conducted in which wood wastes were steam gasified in a fluidized bed reactor at 725° C. (rate of gasification=1 Kg/h). The product gases were then filtered at about 350° C., and introduced into a fluidized catalyst bed maintained at 525° C. and 600° C. simultaneously with the addition of air at a rate of 6.2 l/min.

Catalysts used in the tests included "G90C", "NCM", and "ICI-46-1" (see Table I). The G90C catalysts were used in the form of Rashig rings ground to less than 40 mesh. The NCM catalysts consisted of Ni, Cu, and Mo impregnated on a proprietary, high-surface area support member sold by W. R. Grace Co. The NCM particle size was −40 to +70 mesh spheres. In addition, certain tests involved NCM promoted by impregnation with potassium carbonate as described above. The ICI-46-1 catalysts were used in the form of −25 to +70 particles.

Test results involving plain NCM and NCM having 3.4% by weight potassium (resulting from immersion in a $K_2CO_3$ solution) at a catalysis temperature of 525° C. are described in Table II as follows:

TABLE II

| | From Gasifier | After Catalytic Treatment | From Gasifier | After Catalytic Treatment |
|---|---|---|---|---|
| Temperature, °C. | 725 | 525 | 725 | 525 |
| Catalyst | NCM | → | K-Doped NCM | → |
| Test time, min | 160 | 160 | 127 | 127 |
| Wood feed rate, g/min | 20.75 | | 26.77 | |
| g air/g wood | | .36 | | .28 |
| Steam rate, g/min | 20.6 | | 20.00 | |
| Total gas, l | 4205 | 6445 | 2821 | 4607 |
| g water reacted | | 700 | | 280 |
| % water reacted | | 21 | | 11 |
| Gas composition, vol % | | | | |
| $H_2$ | 21.14 | 29.81 | 21.70 | 27.84 |
| $CO_2$ | 12.52 | 19.07 | 12.81 | 17.49 |
| $C_2H_2$, $C_2H_4$, $C_2H_6$ | 3.11 | 1.03 | 3.60 | 1.83 |
| $CH_4$ | 7.66 | 6.71 | 8.29 | 6.65 |
| CO | 25.23 | 12.94 | 27.52 | 17.61 |
| $C_3H_6$, $C_3H_8$ | .73 | .25 | .80 | .38 |
| $C_4H_8$, $C_4H_{10}$ | .24 | | .32 | .12 |
| $N_2$ | 26.84[b] | 28.39[b] | 22.60[b] | 25.59[b] |
| $H_2O$ | 2.30 | 2.30 | 2.30 | 2.30 |
| Molecular wt. of gas | 23.48 | 22.45 | 23.38 | 22.58 |
| Wt % dry gas | 82 | 106 | 58 | 78 |
| Btu/scf | 302 | 228 | 329 | 256 |
| % C in gas | 70 | 82 | 50 | 65 |
| g $H_2$/100 g wood | 2.23 | 4.82 | 1.50 | 3.14 |
| g CO/100 g wood | 37.28 | 29.31 | 26.63 | 27.84 |
| g $CO_2$/100 g wood | 29.07 | 67.87 | 19.48 | 43.44 |
| Cold gas efficiency[a] | 70.98 | 82.15 | 50.70 | 64.36 |
| % C to char | 10 | 10 | 13 | 13 |
| Wt condensate, g | | 3015 | | 2760 |
| Condensate TOC, mg/l | | 3400 | | 4000 |
| % C to cond | | .63 | | .66 |
| ppm BTX in gas | 22621 | 10022 | 23455 | 2126 |
| Wt % BTX | 2.80 | 1.82 | 1.90 | .27 |
| % C to BTX | 5.10 | 3.31 | 3.45 | .49 |
| ppm $C_8$–$C_{20}$ in gas | 19828 | 5717 | 20336 | 5262 |
| Wt % $C_8$–$C_{20}$ oil | 2.46 | 1.04 | 1.64 | .67 |
| % C to $C_8$–$C_{20}$ oil | 4.18 | 1.76 | 2.79 | 1.14 |
| ppm Heavy oil in gas | 20795 | 1249 | 19661 | 4550 |
| Wt % heavy oil | 2.58 | .23 | 1.59 | .58 |
| % C to heavy oil | 3.86 | .34 | 2.38 | .87 |
| C Balance, % | 95 | 98 | 67 | 79 |

[a]% of energy originally in the wood which is contained in the gas product.
[b]$N_2$ comes from purges used in the test as well as from air in the catalytic reactor.

At 525° C., the NCM and potassium-doped NCM catalysts were effective in reducing the yield of condensible organics (tars/oils) in the product gases. Using NCM, 92% of the heavy oil fraction, 58% of the $C_8$–$C_{20}$ fraction, and 35% of the benzene/toluene/xylene (BTX) fraction were converted to gases. With potassium-doped NCM, these respective conversions were 86%, 59%, and 64%. Increases in carbon conversion to gases were 17% and 30% for NCM and potassium-doped NCM, respectively. The TOC (total organic content) of the condensate was 3400 mg/l 1 in both tests. Without catalytic treatment the condensate TOC usually exceeds 20,000 mg/l.

Tests involving potassium-doped NCM at 600° C. are presented below in Table III:

TABLE III

| | From Gasifier | After Catalytic Treatment | From Gasifier | After Catalytic Treatment |
|---|---|---|---|---|
| Temperature, °C. | 725 | 600 | 725 | 600 |
| Catalyst | | 3.5% K Doped NCM → → | | |
| Test time, min | 242 | 242 | 325 | 325 |
| Wood feed rate, g/min | 17.25 | | 16.98 | |
| g air/g wood | | .43 | | .44 |
| Steam rate, g/min | 20 | | 20.28 | |
| Total gas, l | 4728 | 10121 | 8375 | 13346 |
| g water reacted | | 1500 | | 1900 |
| % water reacted | | 31 | | 29 |
| Gas composition, vol % | | | | |
| $H_2$ | 20.63 | 36.08 | 21.80 | 33.48 |
| $CO_2$ | 11.23 | 17.01 | 10.46 | 15.25 |
| $C_2H_2$, $C_2H_4$, $C_2H_6$ | 2.88 | .32 | 3.13 | .41 |
| $CH_4$ | 7.07 | 4.02 | 6.85 | 3.49 |
| CO | 25.38 | 16.37 | 25.62 | 15.30 |
| $C_3H_6$, $C_3H_8$ | .66 | .02 | .62 | .04 |
| $C_4H_8$, $C_4H_{10}$ | .16 | 0 | .23 | 0 |
| $N_2$ | 30.69[b] | 25.18[b] | 26.74[b] | 28.02[b] |
| $H_2O$ | 2.30 | 2.30 | 2.30 | 2.30 |
| Molecular wt. of gas | 23.79 | 21.00 | 22.49 | 20.61 |
| Wt % dry gas | 70 | 127 | 92 | 114 |
| Btu/scf | 287 | 215 | 295 | 200 |
| % C to gas | 60 | 94 | 80 | 86 |
| g $H_2$/100 g wood | 1.95 | 7.29 | 2.76 | 6.75 |
| g CO/100 g wood | 33.53 | 46.29 | 45.35 | 43.16 |
| g $CO_2$/100 g wood | 23.32 | 75.62 | 29.10 | 67.59 |
| Cold gas efficiency[a] | 60.30 | 96.74 | 82/94 | 89.71 |
| % C to char | 9 | 9 | 6 | 6 |
| Wt condensate, g | | 3895 | | 5190 |
| Condensate TOC, mg/l | | 250 | | 250 |
| % C to cond | | .05 | | .05 |
| ppm BTX in gas | 21866 | 8052 | 10,980 | 5984 |
| Wt % BTX | 2.45 | 1.71 | 1.56 | 1.24 |
| % C to BTX | 4.47 | 3.11 | 2.84 | 2.26 |
| ppm $C_8$–$C_{20}$ in gas | 15236 | 1154 | 10,308 | 1642 |
| Wt % $C_8$–$C_{20}$ oil | 1.71 | .24 | 1.47 | .34 |
| % C to C8–C20 oil | 2.91 | .42 | 2.49 | .58 |
| ppm Heavy oil in gas | 11916 | 240 | 10,926 | 0 |
| Wt % heavy oil | 1.34 | .05 | 1.55 | 0.00 |
| % C to heavy oil | 2.01 | .08 | 2.33 | 0.00 |
| C Balance, % | 78 | 106 | 93 | 94 |

[a] and [b] - See Legend in Table II

The potassium-doped NCM in these tests remained active for over 9.5 hours. As indicated in Table III, yields of heavy oils were reduced by 96%, $C_8$–$C_{20}$ oils were reduced by 86%, and BTX reduced by 30%. The TOC of the condensate was only 250 mg/l. Carbon conversion to gas increased by an average of 30%.

At the end of the 600° C. tests, the carbon content on the catalyst surface was only 0.2% by weight, indicating that air addition effectively removed carbon from the catalyst surface. Air addition to the catalytic reactor at 525° C. was only partially effective in preventing carbon deposition on the NCM surface. No carbon deposition occurred when the reaction temperature was increased to 600° C.

Table IV shows the results obtained when the G90C catalyst was used at a temperature of 600° C.:

TABLE IV

| | From Gasifier | After Catalytic Treatment |
|---|---|---|
| Temperature, °C. | 715 | 600 |
| Catalyst | | G-90C |
| Test time, min | 330 | 330 |
| Wood feed rate, g/min | 16.61 | |
| g air/g wood | | .45 |
| Steam rate, g/min | 19.5 | |
| Total gas, l | 7289 | 15394 |
| g water reacted | | 3000 |
| % water reacted | | 47 |

TABLE IV-continued

| | From Gasifier | After Catalytic Treatment |
|---|---|---|
| Gas composition, vol % | | |
| $H_2$ | 19.63 | 41.76 |
| $CO_2$ | 10.45 | 20.33 |
| $C_2H_2$, $C_2H_4$, $C_2H_6$ | 3.21 | 0 |
| $CH_4$ | 7.09 | 2.18 |
| CO | 27.69 | 10.15 |
| $C_3H_6$, $C_3H_8$ | .62 | 0 |
| $C_4H_8$, $C_4H_{10}$ | .2 | 0 |
| $N_2$ | 28.42[b] | 23.35[b] |
| $H_2O$ | 2.30 | 2.30 |
| Molecular wt. of gas | 23.54 | 19.92 |
| Wt % dry gas | 84 | 141 |
| Btu/scf | 297 | 189 |
| % C to gas | 73 | 93 |
| g $H_2$/100 g wood | 2.17 | 9.77 |
| g CO/100 g wood | 42.95 | 33.24 |
| g $CO_2$/100 g wood | 25.48 | 104.66 |
| Cold gas efficiency[a] | 73.28 | 98.49 |
| % C to char | 7 | 7 |
| Wt condensate, g | | 4340 |
| Condensate TOC, mg/l | | 1 |
| % C to cond | | 0.00 |
| ppm BTX in gas | 13,622 | 801 |
| Wt % BTX | 1.78 | .19 |
| % C to BTX | 3.23 | .34 |
| ppm $C_8$–$C_{20}$ in gas | 12,970 | 614 |
| Wt % $C_8$–$C_{20}$ oil | 1.69 | .14 |
| % C to $C_8$–$C_{20}$ oil | 2.87 | .24 |
| ppm Heavy oil in gas | 13,194 | 0 |

TABLE IV-continued

| | From Gasifier | After Catalytic Treatment |
|---|---|---|
| Wt % heavy oil | 172 | 0.00 |
| % C to heavy oil | 2.58 | 0.00 |
| C Balance, % | 89 | 101 |

[a] and [b] - See Legend in Table II

At 600 ° C., G90C was extremely effective in catalyzing tar destruction by catalytic partial oxidation. The catalyst remained active throughout the 5.5 hour test. The TOC of the condensate from the scrubber/condenser was less than the detection limit of the elemental analyzer used in the test. Carbon accountability was 100%, with the gaseous product containing 93% of the carbon, and the residual char containing 7%. At the end of the test, the carbon content on the G90C catalyst was 5% by weight which did not significantly impair catalyst activity.

Finally, tests involving ICI-46-1 are described below in Table V:

TABLE V

| | Test #1 | | Test #2 | |
|---|---|---|---|---|
| Conditions | Gasifier | Catalytic Reactor | Gasifier | Catalytic Reactor |
| Temp, °C. | 725 | 600 | 725 | 600 |
| $H_2O$ rate, g/min | 6.28 | | 7.39 | |
| Air flow, L/min | | 6.20 | | 6.20 |
| $N_2$ flow, L/min | 14 | | 14 | |
| Wood feed rate, g/min | 16.09 | | 13.78 | |
| lb/hr-ft$^3$ | 43.35 | | 37.12 | |
| Gas comp, vol % | | | | |
| $H_2$ | 14.59 | 26.08 | 12.62 | 25.02 |
| $CO_2$ | 6.85 | 12.11 | 5.83 | 12.04 |
| $C_2H_4$, $C_2H_6$ | 2.43 | 0.38 | 1.57 | 0.32 |
| $CH_4$ | 5.66 | 4.26 | 4.82 | 3.21 |
| CO | 21.76 | 15.24 | 18.83 | 11.96 |
| $N_2$ | 46.00[b] | 39.04[b] | 50.68[b] | 43.32[b] |
| $C_3H_6$, $C_3H_8$ | 0.30 | 0.03 | 0.47 | 0.03 |
| $C_4H_6$, $C_4H_8$, $C_4H_{10}$ | 0.07 | 0.00 | 0.15 | 0.00 |
| $H_2O$ | 2.00 | 2.00 | 2.00 | 2.00 |
| Total | 99.44 | 99.14 | 96.96 | 97.90 |
| Cold gas efficiency[a] | 70 | 93 | 72 | 92 |
| ppm benzene/toluene/xylene | 14,000 | 1,500 | 14,000 | 1,500 |
| ppm tars | 7,500 | 0 | 7,500 | 50 |

[a] and [b] - See Legend in Table II

At 600° C., the ICI-46-1 catalyst effectively eliminated tars and improved gas yields. Essentially all of the heavy hydrocarbons (tars in Table V) were destroyed, and about 90% of the BTX fraction was destroyed. The cold gas efficiency was increased from about 70% to over 90% through the use of ICI-46-1 catalyst.

Figure 2:
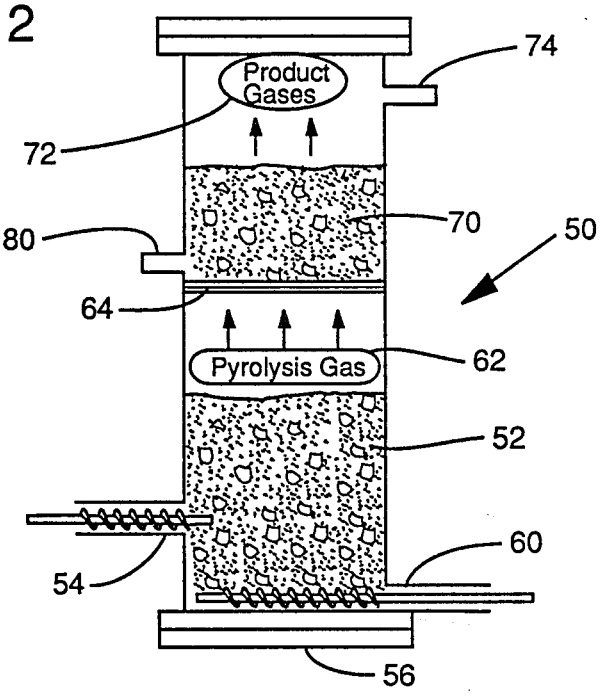
FIG. 2 is a schematic representation of an alternative processing system usable in conjunction with the invention.

Having herein described a preferred embodiment of the invention it will be apparent that modifications may be made thereto within the scope of the invention. For example, the foregoing process may also be implemented using a staged reactor design illustrated in FIG. 2. The staged design consists of a single reactor 50 having a primary fluid bed 52, feedstock inlet 54, steam/gas inlet 56 and waste outlet 60. Pyrolysis gases 62 are produced in the bed 52 and move upwardly through a distributor plate 64. They are then reacted in a secondary catalytic fluidized bed 70 in order to remove tar/oil materials therefrom. The product gases 72 are then released through an outlet 74. Addition of a gaseous oxidizing agent to prevent catalyst contamination occurs through an inlet 80 directly above the distributor plate 64. However, the fundamental principles inherent in the operation of this system are the same as those of the system shown in FIG. 1.

In addition, the catalytic reactor 26 may be retrofitted onto an existing pyrolysis/gasification reactor in order to eliminate tars and increase gas yields. Such results will be achieved in a retrofit system as long as the process steps of the invention described herein are followed.

The scope of the invention shall therefore be limited only in accordance with the following claims:

What is claimed is:

1. A method for producing pyrolysis gases from carbon-containing materials comprising:

pyrolyzing said carbon-containing materials in a gasification reactor in order to form pyrolysis gases therefrom, said pyrolysis gases having residual tar and oil byproducts entrained therein;

passing said pyrolysis gases from said gasification reactor into and through a catalytic reactor having a fluidized bed therein for eliminating said tar and oil byproducts from said pyrolysis gases, said catalytic reactor being maintained at a temperature of about 550°-750° C. and containing at least one catalyst therein; and introducing a gaseous oxidizing agent selected from the group consisting of air, oxygen, steam, and mixtures thereof into said catalytic reactor, said gaseous oxidizing agent being introduced into said catalytic reactor and released into said bed of said catalytic reactor in a direction perpendicular to the longitudinal axis of said reactor, said oxidizing agent being introduced at a flow rate sufficient to impart a swirling motion to said catalyst in said catalytic reactor in order to react with any deposited carbon on said catalyst to enable the oxidation and removal of said carbon therefrom.

2. The method of claim 1 wherein said gasification reactor comprises a fluidized bed reactor.

3. The method of claim 1 wherein said gasification reactor comprises a fixed bed reactor.

4. The method of claim 1 wherein said gasification reactor comprises an entrained bed reactor.

5. The method of claim 1 wherein said gasification reactor is maintained at a temperature of about 600°-800° C. in order to form said pyrolysis gases.

6. The method of claim 1 wherein said catalytic reactor comprises a distribution plate therein, said catalyst being positioned above said plate, with said introducing of said gaseous oxidizing agent into said catalytic reactor occurring above said plate.

7. The method of claim 1 wherein said catalyst comprises a nickel-containing compound.

8. A method for producing pyrolysis gases from carbon-containing materials comprising:

pyrolyzing said carbon-containing materials in a gasification reactor, said gasification reactor being maintained at a temperature of about 600°-800° C. in order to form pyrolysis gases from said carbon-containing materials, said pyrolysis gases having residual tar and oil byproducts entrained therein;

passing said pyrolysis gases from said gasification reactor into and through a catalytic reactor having a fluidized bed therein for eliminating said tar and oil byproducts from said pyrolysis gases, said catalytic reactor comprising a distribution plate and at least one nickel-containing catalyst therein positioned above said plate, said catalytic reactor being maintained at a temperature of about 550°–750° C.; and introducing a gaseous oxidizing agent selected from the group consisting of air, oxygen, steam, and mixtures thereof into said catalytic reactor, said gaseous oxidizing agent being introduced into said catalytic reactor above said distribution plate and released into said bed of said catalytic reactor in a direction perpendicular to the longitudinal axis of said reactor, said oxidizing agent being introduced at a flow rate sufficient to impart a swirling motion to said catalyst in said catalytic reactor in order to react with any deposited carbon on said catalyst to enable the oxidation and removal of said carbon therefrom.

9. A method for producing pyrolysis gases from carbon-containing materials in a system wherein said carbon-containing materials are first treated in a gasification reactor to form pyrolysis gases having residual tar and oil byproducts entrained therein, said method comprising:

retrofitting a catalytic reactor having a fluidized bed therein for eliminating said tar and oil byproducts from said pyrolysis gases onto said gasification reactor;

passing said pyrolysis gases from said gasification reactor into and through said fluidized bed catalytic reactor, said catalytic reactor being maintained at a temperature of about 550°–750° C. and containing at least one catalyst therein; and introducing a gaseous oxidizing agent selected from the group consisting of air, oxygen, steam, and mixtures thereof into said catalytic reactor, said gaseous oxidizing agent being introduced into said catalytic reactor and released into said bed of said catalytic reactor in a direction perpendicular to the longitudinal axis of said reactor, said oxidizing agent being introduced at a flow rate sufficient to impart a swirling motion to said catalyst in said catalytic reactor in order to react with any deposited carbon on said catalyst to enable the oxidation and removal of said carbon therefrom.

10. The method of claim 9 wherein said catalytic reactor comprises a distribution plate therein, said catalyst being positioned above said plate, with said introducing of said gaseous oxidizing agent into said catalytic reactor occurring above said plate.

11. The method of claim 9 wherein said catalyst comprises a nickel-containing compound.

* * * * *